US012280306B1

(12) United States Patent
Wang

(10) Patent No.: US 12,280,306 B1
(45) Date of Patent: Apr. 22, 2025

(54) DUAL-AREA FITNESS EQUIPMENT

(71) Applicant: Wall Home Inc, Denver, CO (US)

(72) Inventor: Ruibo Wang, Denver, CO (US)

( * ) Notice: Subject to any disclaimer, the term of this patent is extended or adjusted under 35 U.S.C. 154(b) by 0 days.

(21) Appl. No.: 18/813,016

(22) Filed: Aug. 23, 2024

(51) Int. Cl.

| | |
|---|---|
| ***A63B 71/02*** | (2006.01) |
| ***A63B 21/00*** | (2006.01) |
| ***A63B 21/062*** | (2006.01) |
| ***A63B 21/072*** | (2006.01) |
| ***A63B 21/078*** | (2006.01) |
| ***A63B 23/12*** | (2006.01) |

(52) U.S. Cl.
CPC ..... *A63B 71/023* (2013.01); *A63B 21/0628* (2015.10); *A63B 21/0724* (2013.01); *A63B 21/078* (2013.01); *A63B 21/156* (2013.01); *A63B 23/1209* (2013.01); *A63B 2225/105* (2013.01)

(58) Field of Classification Search
CPC ..... A63B 21/0628; A63B 21/0724; A63B 21/078; A63B 21/156; A63B 23/1209; A63B 71/023; A63B 2225/105
See application file for complete search history.

(56) References Cited

U.S. PATENT DOCUMENTS 6,447,430 B1 * 9/2002 Webb ..... A63B 23/00 482/93
6,488,612 B2 * 12/2002 Sechrest ..... A63B 21/152 482/138
7,169,093 B2 * 1/2007 Simonson ..... A63B 21/156 482/138
7,503,882 B2 * 3/2009 Sechrest ..... A63B 21/4047 482/138
7,575,538 B1 * 8/2009 Clark ..... A63B 23/0355 482/142
7,601,105 B1 * 10/2009 Gipson, III ..... A63B 21/156 482/138
7,632,221 B1 * 12/2009 Kolander ..... A63B 23/03525 482/102
8,057,368 B1 * 11/2011 Lyszczarz ..... A63B 21/0628 482/142
8,096,926 B1 * 1/2012 Batca ..... A63B 21/156 482/99
9,302,136 B2 * 4/2016 Lyszczarz ..... A63B 21/4035
10,500,442 B2 * 12/2019 Hong ..... A63B 21/156
11,110,313 B2 * 9/2021 Gore ..... A63B 21/078
11,389,689 B2 * 7/2022 Leipheimer ..... A63B 21/0628
11,458,350 B2 * 10/2022 Yang ..... A63B 21/00065
11,931,618 B2 * 3/2024 Meredith ..... A63B 23/1209
2003/0017918 A1 * 1/2003 Webb ..... A63B 21/156 482/99
2007/0173384 A1 * 7/2007 Sechrest ..... A63B 21/154 482/99
2019/0240525 A1 * 8/2019 Leipheimer ..... A63B 21/0724
2019/0336812 A1 * 11/2019 Leipheimer ..... A63B 23/03525
2022/0096891 A1 * 3/2022 Yang ..... A63B 21/0428

* cited by examiner

*Primary Examiner* — Joshua Lee
(74) *Attorney, Agent, or Firm* — Hawaii Patent Services; Nathaniel K. Fedde; Kenton N. Fedde

(57) ABSTRACT

Dual-area fitness equipment comprises a frame, wherein the frame is provided with at least two exercise areas arranged oppositely, and the two exercise areas are respectively set as a first exercise area and a second exercise area; exercise devices are arranged in the first exercise area and the second exercise area, wherein one exercise device is a fly exercise device; wherein, at least one fly exercise device is arranged and can be adjusted in angle.

10 Claims, 10 Drawing Sheets

A

B

C

D

E

DUAL-AREA FITNESS EQUIPMENT

TECHNICAL FIELD

The present invention relates to the technical field of fitness equipment, in particular to dual-area fitness equipment.

BACKGROUND

The fly exerciser, also known as the "big bird" or "gantry crane", is a common professional equipment in the gym, and has multiple functions and can be used to exercise muscles in all parts of the body. Smith frame is also a very common fitness equipment in the gym, and it consists of a vertical metal frame and a barbell that slides up and down in the frame.

At present, the vast majority of fly exercisers and Smith frames are two independent fitness equipment, and both of them are large in size, so when the fly exercisers and Smith frames are placed separately, they occupy a large area and are not suitable for some fitness areas with small space.

For example, the US patent with a number of U.S. Ser. No. 11/998,787B2 discloses "Exercise bar carriage locking mechanism", which only has the flay exercise function. Moreover, the angle adjustment range of the fly exercise device in this patent is limited, and the proportion of counterweight transmitted by the pulley block in this patent is low, so that more counterweight blocks need to be applied and the exercise cost is higher.

For another example, the US patent with a publication number of US20130303348A1 discloses a "Load-adjusting device and locking device", which also only has a Smith frame.

Therefore, there is a need to propose a new type of fitness equipment, which has at least a fly exercise device and a push-up exercise device at the same time, thus reducing the floor space of the fitness equipment. At the same time, the fly exercise device can be adjusted in a wide range of angles, and the balance weight ratio of the pulley block is high. At the same time, the push-up exercise device is also capable of adjusting the inclination.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

The present invention provides dual-area fitness equipment to solve that problems that the exist fitness equipment occupies a large area, the angle adjustment range of a fly exercise device is limited, the weight ratio is low, and the inclination adjustment cannot be performed for a push-up exercise device.

In order to achieve the above object, the present invention adopts the following technical solutions.

The present invention provides dual-area fitness equipment, which includes a rack, wherein the rack is provided with at least two exercise areas arranged oppositely, and the two exercise areas are respectively set as a first exercise area and a second exercise area; and the first exercise area and the second exercise area are both provided with exercise devices, wherein one of the exercise devices is a fly exercise device;

wherein, the fly exercise device is provided with at least one set and can be adjusted in angle, and the fly exercise device is matched with a fly counterweight device and a pulley transmission device; and wherein, the fly counterweight device and the pulley transmission device are both located between the first exercise area and the second exercise area.

The present invention further provides dual-area fitness equipment, which includes a rack, wherein, the rack is provided with at least two exercise areas arranged oppositely, and the two exercise areas are respectively set as a first exercise area and a second exercise area; and the first exercise area and the second exercise area are both provided with exercise devices, wherein one of the exercise devices is a push-up exercise device with an adjustable inclination;

the push-up exercise device includes a push-up mechanism and an inclination adjusting mechanism, wherein the push-up mechanism includes at least two adjusting frames and at least one barbell bar; and the two adjusting frames can turn over in an opening direction of the exercise area, and the barbell bar is arranged between the two adjusting frames.

The present invention further provides dual-area fitness equipment, which includes a rack, wherein, the rack is provided with at least two exercise areas arranged oppositely, and the two exercise areas are respectively set as a first exercise area and a second exercise area; and the first exercise area and the second exercise area are both provided with exercise devices, and two of the exercise devices are a fly exercise device and/or a push-up exercise device.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

Figure 1:
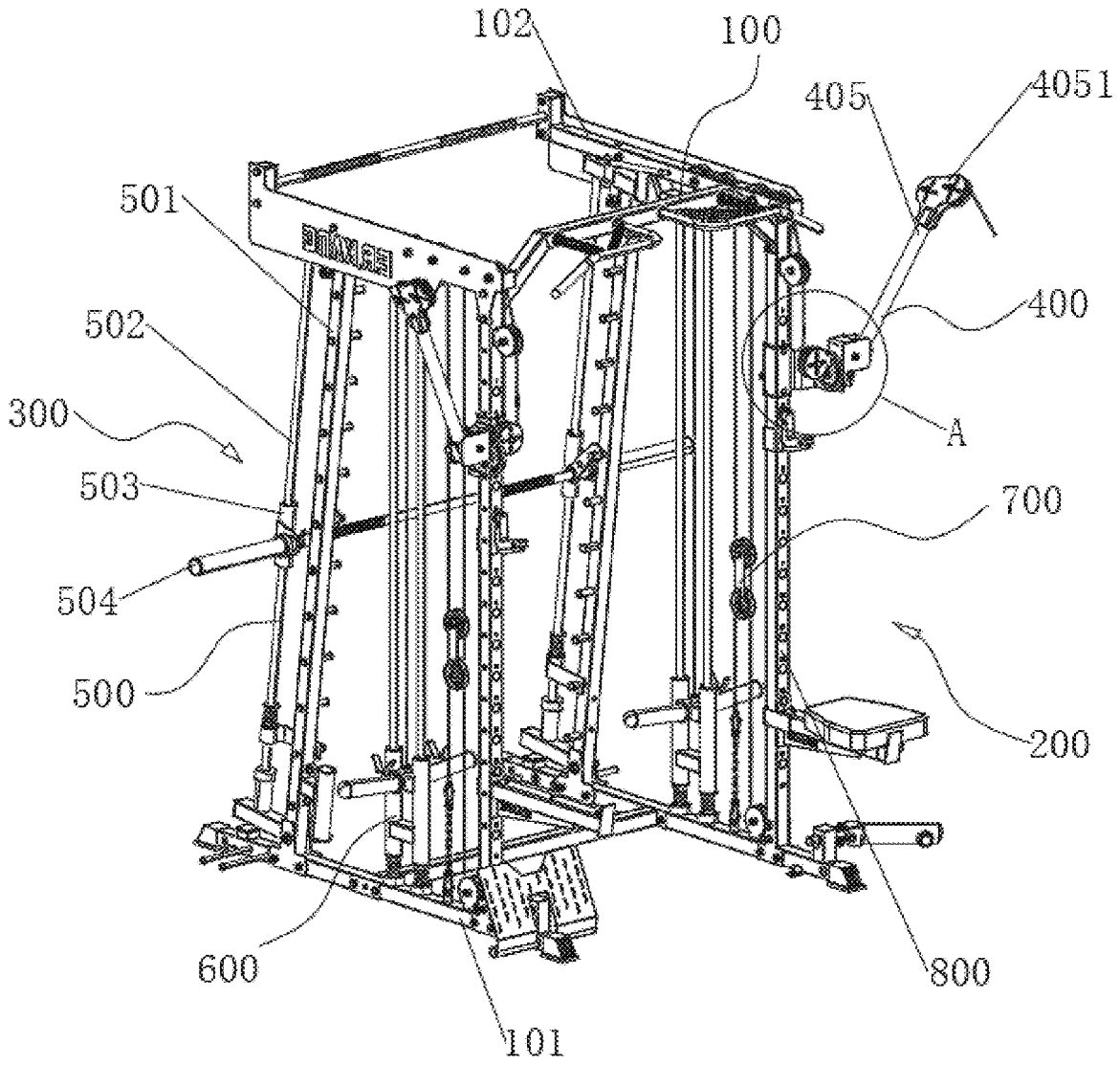
FIG. 1 is a schematic structural diagram of the whole invention.

Reference signs: Rack (100); Bottom bracket (101); Cushion block (1011); Top bracket (102); First positioning hole (1021); Limit block (1022); Telescopic rod (1023); First exercise area (200); Second exercise area (300); Fly exercise device (400); Adjusting sleeve (401); Z-shaped plate (402); Second positioning hole (4021); First guide pulley (403); U-shaped frame (404); Fly arm (405); Guide pulley block (4051); Rotating member (4052); Third positioning hole (4053); Hollow shaft (4054); Fixing pin (406); Second positioning pin (407); Third positioning pin (408); Second guide pulley (409); Push-up exercise device (500); Adjusting frame (501); Connecting sheet (5011); Guide rod (502); Sliding sleeve (503); Barbell bar (504); First positioning pin (505); Fly counterweight device (600); Guide frame (601); Sliding frame (602); Balance weight lever (603); Pulley transmission device (700); Movable pulley block (701); First fixed pulley (702); Second fixed pulley (703); Tension rope (704); Limit rope (705); Adjusting rod (800).

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

Embodiment 1

Figure 3:
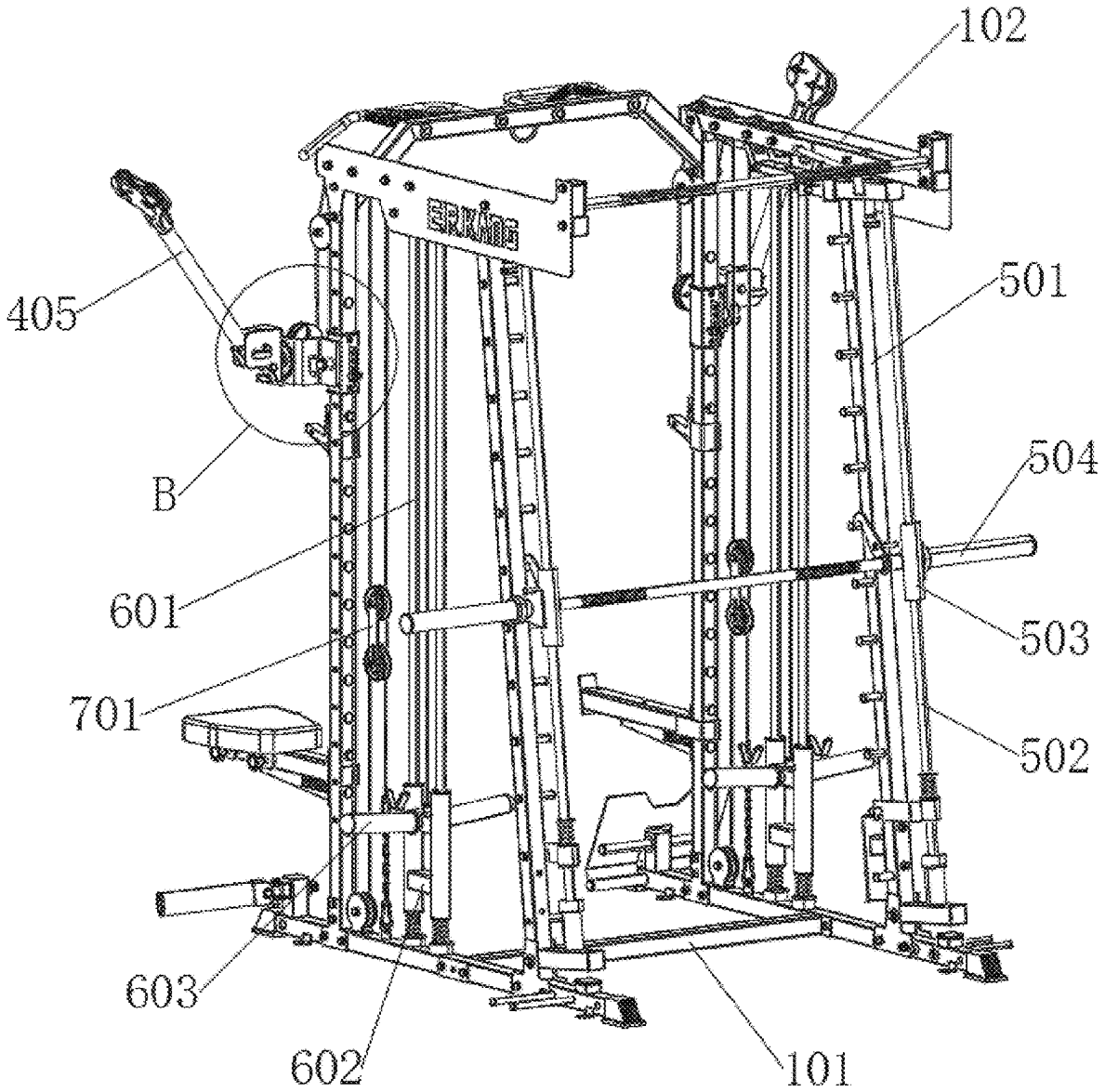
FIG. 3 is a structural schematic diagram of the entire invention from another perspective.
Figure 4:
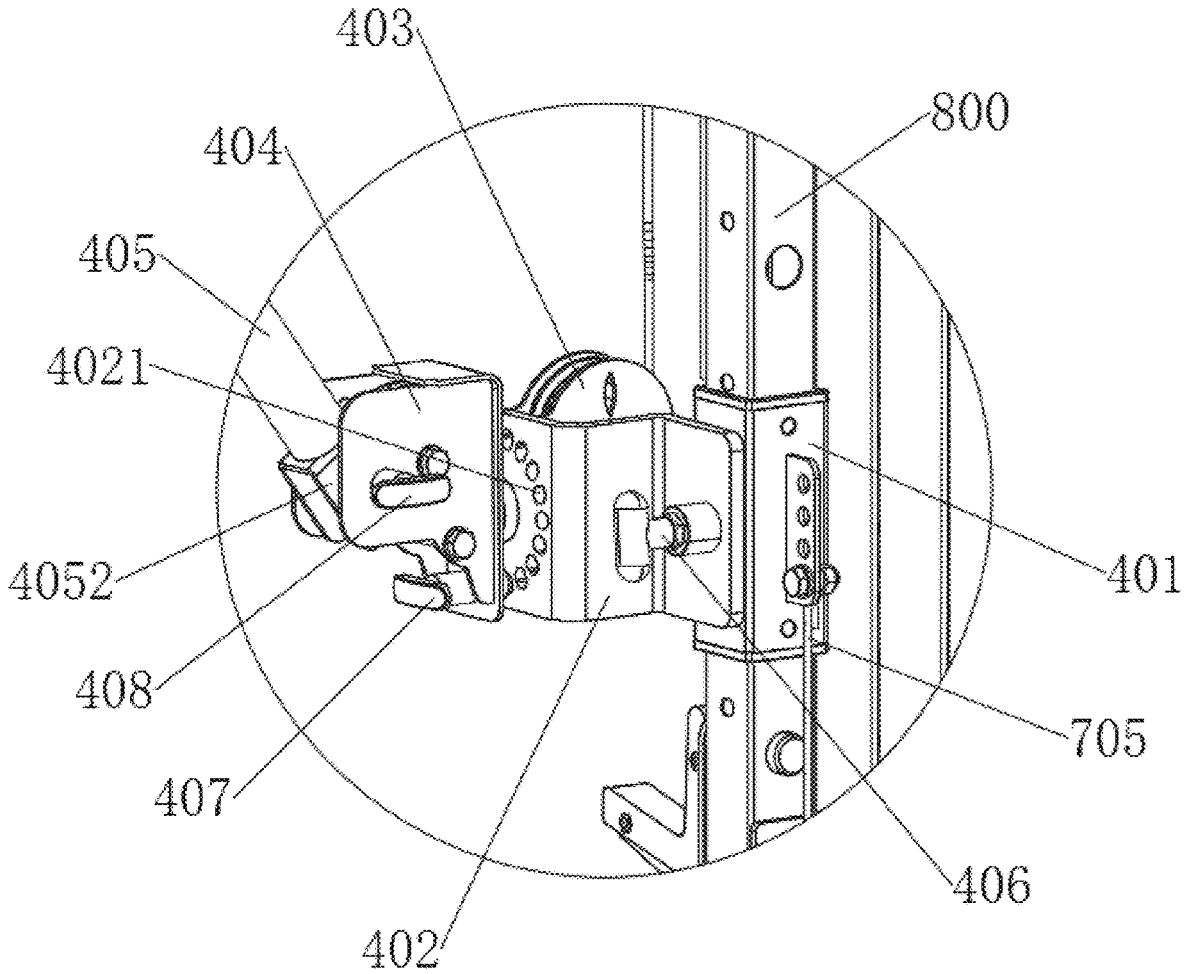
FIG. 4 is a partially enlarged schematic view at C in FIG. 3 according to the present invention.

Please refer to FIG. 1, FIG. 3 and FIG. 4.

The present invention provides dual-area fitness equipment, which includes a rack 100, wherein the rack 100 is provided with at least two exercise areas which are arranged oppositely, and the two exercise areas are respectively set as a first exercise area 200 and a second exercise area 300, and exercise devices are arranged in the first exercise area 200 and the second exercise area 300, wherein one exercise device is a fly exercise device 400; wherein, there are at least one set of fly exercise devices 400 which can be adjusted in angle, and the fly exercise device 400 is equipped with a fly counterweight device 600 and a pulley transmission device 700; wherein, the fly counterweight device 600 and the pulley transmission device 700 are both located between the first exercise area 200 and the second exercise area 300.

In this embodiment, two exercise areas are respectively arranged on the left and right sides of the rack 100 and share one rack 100, so that in this way, the fitness equipment can be used for two people to exercise at the same time without interfering with each other, thereby reducing the occupied area and improving the space utilization rate.

The two exercise areas are not limited to the above-mentioned arrangement. In other embodiments (not shown), the two exercise areas on the rack 100 can also be arranged in front and back, or they can be arbitrarily arranged in two opposite and non-interfering areas. Therefore, in this way, it is ensured that fitness equipment can adapt to different spatial layouts and user needs, thus achieving wider applicability and convenience. It is ensured that users do not interfere with each other when exercising, and at the same time realize the optimal use of space.

In this embodiment, the fly exercise device 400 is installed in the first exercise area 200, and the exercise device in the second exercise area 300 can be set as an exercise apparatus such as a tension trainer.

Preferably, the fly counterweight device 600 and the pulley transmission device 700 are located between the first exercise area 200 and the second exercise area 300. By arranging the fly counterweight device 600 and the pulley transmission device 700 between the first exercise area 200 and the second exercise area 300, the fitness equipment can be made more compact, thereby reducing the volume, reducing the occupied area and realizing the optimal utilization of space.

Through the fly exercise device 400, fly exercise can be performed, focusing on improving the strength and endurance of shoulder muscles.

In this embodiment, the fly exercise devices 400 are arranged in two sets, and the two sets of fly exercise devices 400 are installed in the first exercise area 200 in a symmetrical manner. Through two sets of symmetrically distributed fly exercise devices 400, it is possible to exercise both arms at the same time and improve the exercise effect.

The rack 100 includes a bottom bracket 101 and a top bracket 102, which are vertically distributed and fixedly installed together. The first exercise area 200 is provided with at least one adjusting rod 800, which is fixedly installed between the bottom bracket 101 and the top bracket 102. An adjusting sleeve 401 is sleeved on the adjusting rod 800, and a fixing pin 406 matched with the adjusting rod 800 is inserted into the adjusting sleeve 401. The fly exercise device 400 is fixedly installed on the adjusting sleeve 401, and includes a first angle adjusting mechanism, a second angle adjusting mechanism and a fly arm 405.

Referring to FIG. 4, the adjusting sleeve 401 can slide up and down along the adjusting rod 800, thereby adjusting the height of the fly exercise device 400. In this embodiment, the adjusting rod 800 is evenly provided with a plurality of pin holes corresponding to the fixing pins 406 from top to bottom, so that when the adjusting sleeve 401 is moved to the required position, the fixing pins 406 are inserted into the corresponding pin holes, so that the adjusting sleeve 401 and the fly exercise device 400 can be fixed to the current height.

The first angle adjustment mechanism can adjust the circumferential angle of the fly arm 405, and the second adjustment mechanism can adjust the inclination angle of the fly arm 405.

According to the above, in this embodiment, the first angle adjusting mechanism includes a Z-shaped plate 402 fixedly installed on one side of the adjusting sleeve 401 and a U-shaped frame 404 vertically installed on one side of the Z-shaped plate 402 and rotatably connected with the Z-shaped plate 402.

The U-shaped frame 404 can rotate 360 degrees along the Z-shaped plate 402, so that the fly arm 405 can also rotate 360 degrees, thereby adjusting the circumferential angle of the fly arm 405.

Please refer to FIG. 10 and FIG. 11, in the above embodiment, the preferred rotation mode between the U-shaped frame 404 and the Z-shaped plate 402 is as follows:

a hollow shaft 4054 is fixedly installed on one side of the U-shaped frame 404 facing the Z-shaped plate 402, and the other end of the hollow shaft 4054 is inserted into the Z-shaped plate 402 and rotatably connected with the Z-shaped plate 402; the side of the Z-shaped plate 402 connected with the U-shaped frame 404 is provided with a plurality of second positioning holes 4021, which are symmetrically distributed around the hollow shaft 4054, and second positioning pins 407 are inserted into one side of the U-shaped frame 404 facing the Z-shaped plate 402, and the second positioning pins 407 are used in cooperation with the second positioning holes 4021.

The hollow shaft 4054 is hollow inside and can rotate 360 degrees on the Z-shaped plate 402, and through the hollow shaft 4054, the rotating member 4052 can be turned over within the U-shaped frame 404 by 0 to 180 degrees. During overturning, the fly arm 405 is overturned synchronously, so that the inclination angle of the fly arm 405 is adjusted from 0 to 180 degrees. Through the cooperation of the third positioning hole 4053 and the third positioning pin 408, when the fly arm 405 is adjusted to the required angle, the third positioning pin 408 is inserted into the corresponding third positioning hole 4053, so that the fly arm 405 can be fixed to the current angle.

In this embodiment, the fly arm 405 has an internal hollow structure. After the tension rope 704 passes through the hollow shaft 4054, the tension rope 704 can enter the fly arm 405 again and then pass out of the other end of the fly arm 405.

Figure 2:
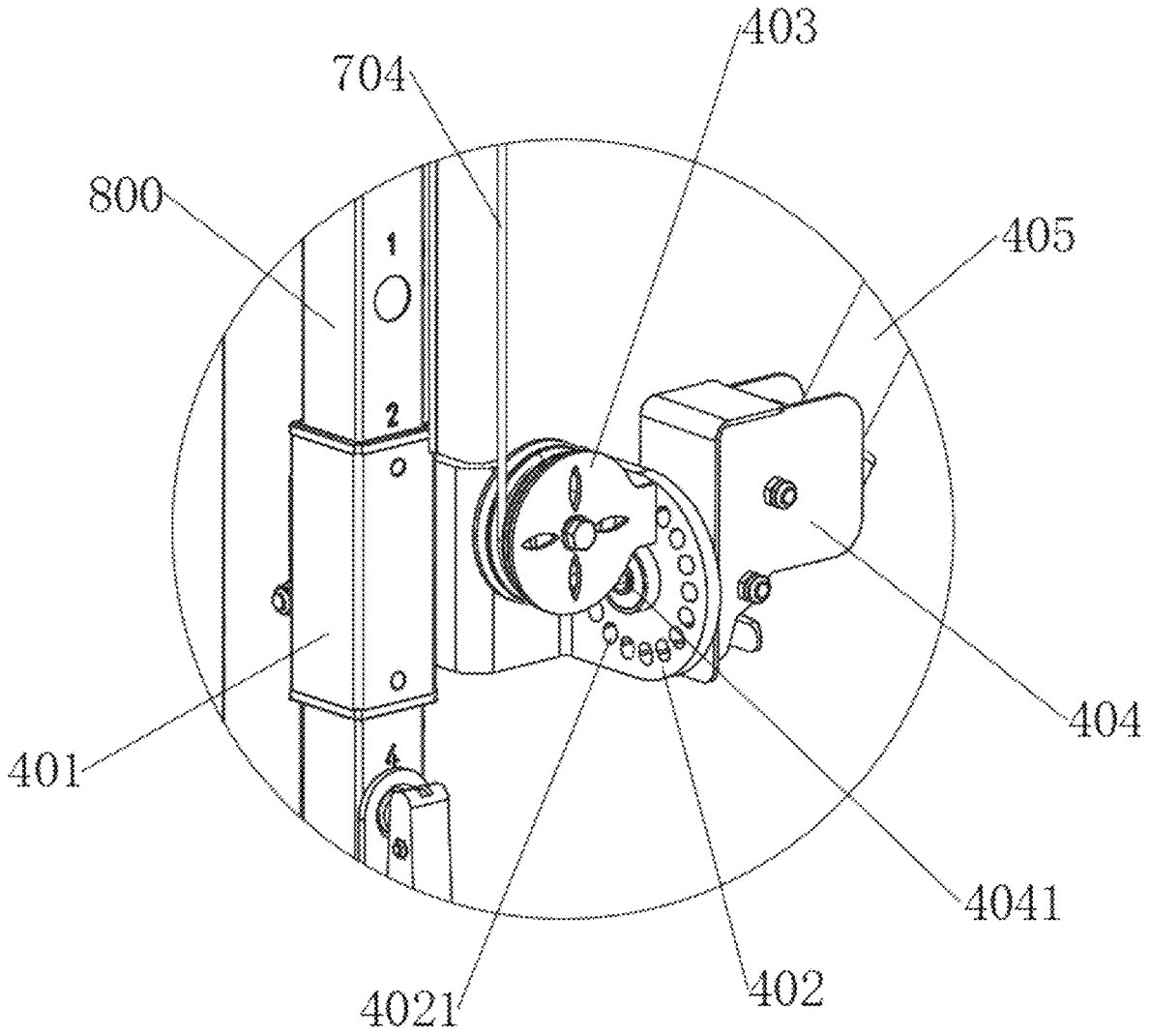
FIG. 2 is a partially enlarged schematic view at A in FIG. 1 according to the present invention.
Figure 10:
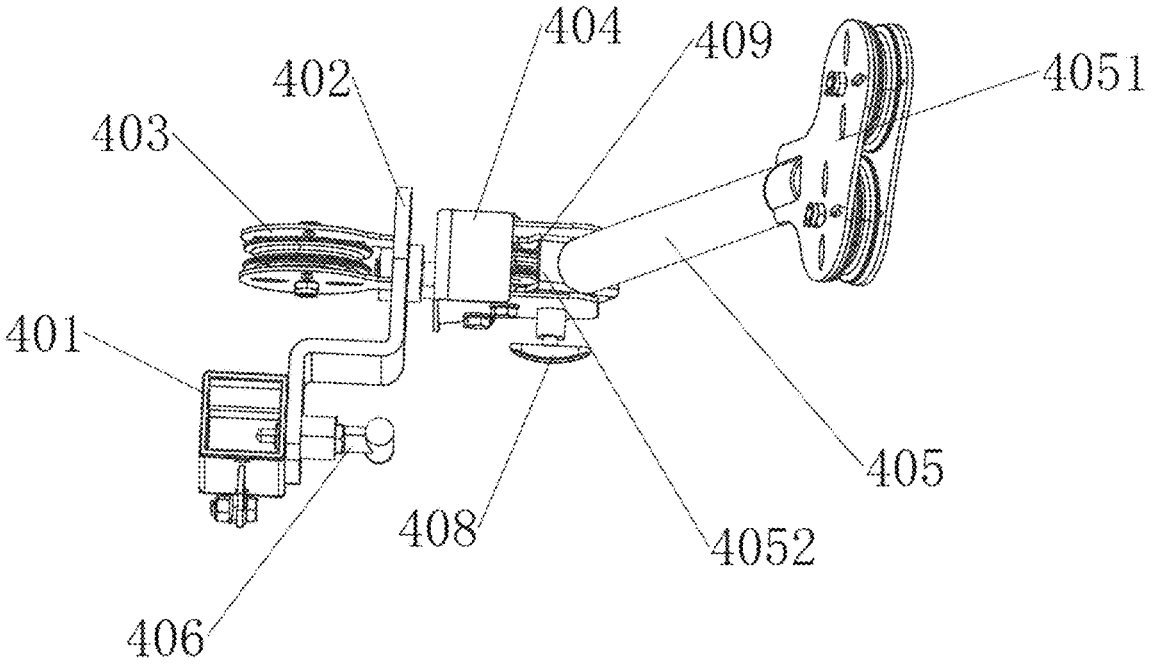
FIG. 10 is a schematic structural diagram of the fly exercise device according to the present invention.
Figure 11:
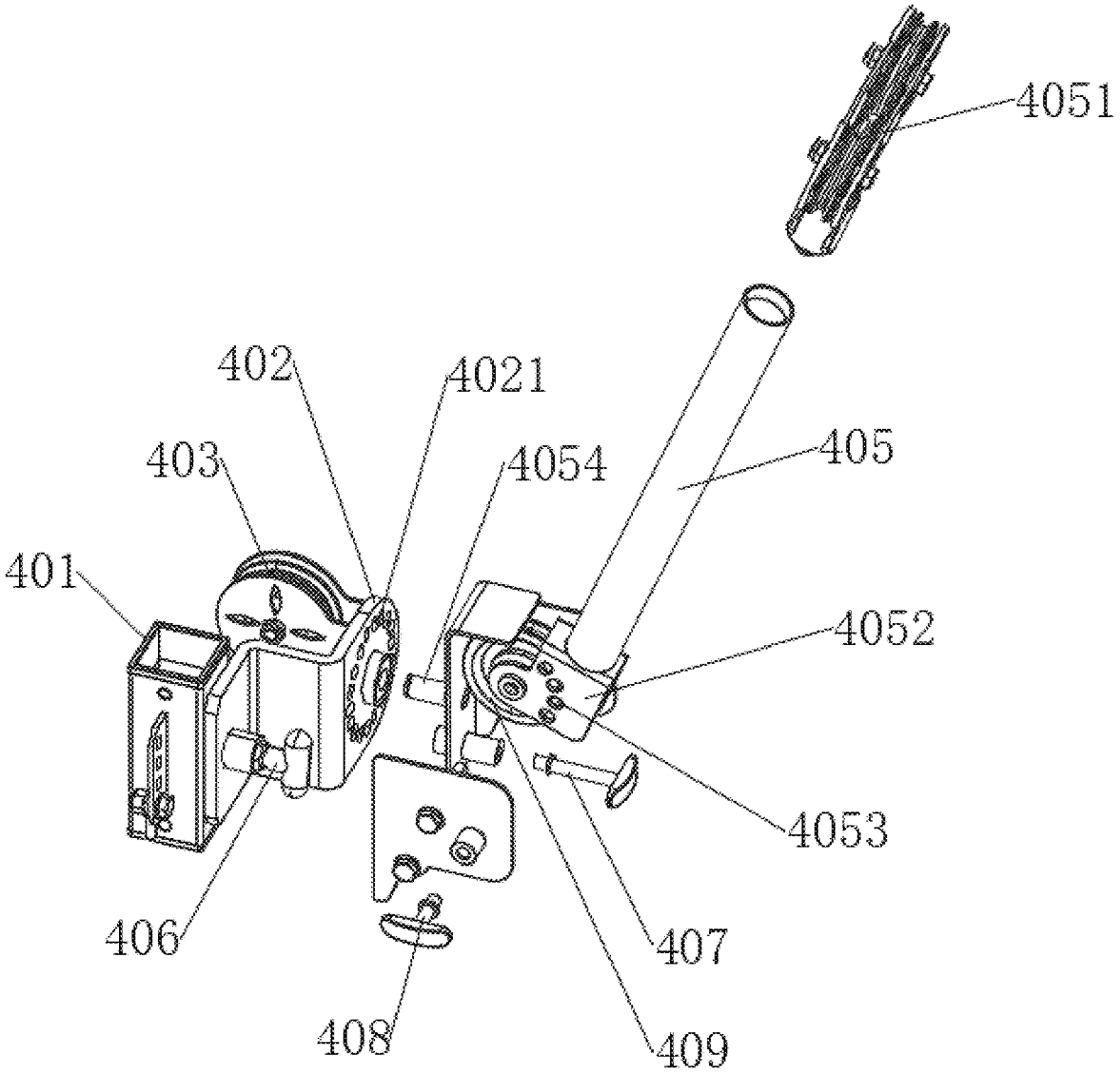
FIG. 11 is an exploded view of the fly exercise device according to the present invention.

Please refer to FIG. 2, FIG. 10 and FIG. 11, in this embodiment, a first guide pulley 403 is installed on the Z-shaped plate 402 in order to make the tension rope 704 smoothly shuttle in the fly exercise device 400. Before the tension rope 704 penetrates into the hollow shaft 4054, the tension rope 704 can slip from the outside of the first guide pulley 403. At this time, the first guide pulley 403 plays a guiding role to ensure the smooth movement of the tension rope 704. Further, a second guide pulley 409 is installed in the U-shaped frame 404, and the second guide pulley 409 is coaxially arranged with the rotating member 4052, thus forming a coordinated movement mechanism. When the tension rope 704 is ready to enter the fly arm 405, the tension rope 704 can also slide over the outside of the second guide pulley 409, and be accurately guided, so as to ensure that the movement of the tension rope 704 is more stable. At the other end of the fly arm 405, a guide pulley block 4051 is installed, and the guide pulley block 4051 is composed of two pulleys. When the tension rope 704 passes through the fly arm 405, the tension rope 704 will slide through the guide pulley block 4051. The guide pulley block 4051 not only provides effective guidance, but also avoids unnecessary contact and friction between the tension rope 704 and the fly arm 405, thus ensuring the safety and smoothness of the whole exercise process.

According to the above, the fly counterweight device 600 includes a guide frame 601, a sliding frame 602 and a balance weight lever 603, wherein the guide frame 601 is fixedly installed between the bottom bracket 101 and the top bracket 102, and the sliding frame 602 is sleeved on and slidably connected with the guide frame 601, and at least one balance weight lever 603 is installed on the sliding frame 602 for penetrating the weight stack. The pulley transmission device 700 includes a movable pulley block 701 consisting of at least two pulleys, a tension rope 704 and a limit rope 705. The tension rope 704 is wound around one pulley of the movable pulley block 701 and forms a left part and a right part, wherein one part of the tension rope 704 is connected with the sliding frame 602, and the other part of the tension rope 704 penetrates into the fly exercise device 400. The limit rope 705 is wound around another pulley of the movable pulley block 701 and forms a left part and a right part, wherein one part of the limit rope 705 is connected with the bottom bracket 101 and the other part of the limit rope 705 is connected with the adjusting sleeve 401.

Figure 7:
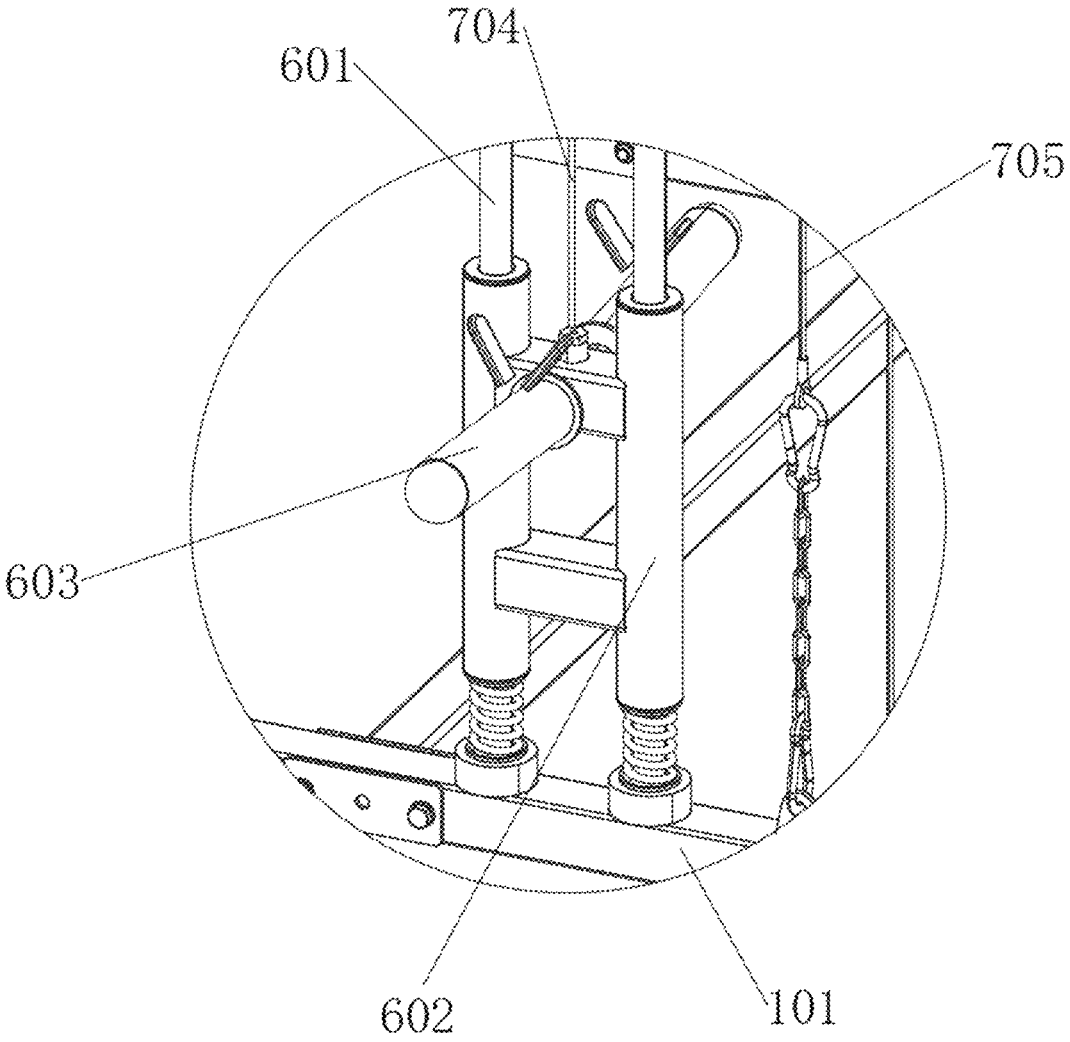
FIG. 7 is a partially enlarged schematic view at D in FIG. 5 according to the present invention.

Please refer to FIG. 7 the balance weight lever 603 can be sleeved with a weight stack to load the weight device, and the tension rope 704 is connected between the weight device and the fly exercise device 400. When the tension rope 704 is pulled out of the fly exercise device 400, the sliding frame 602 can be pulled to slide up and down on the guide frame 601. In this way, rope exercise can be performed.

Figure 5:
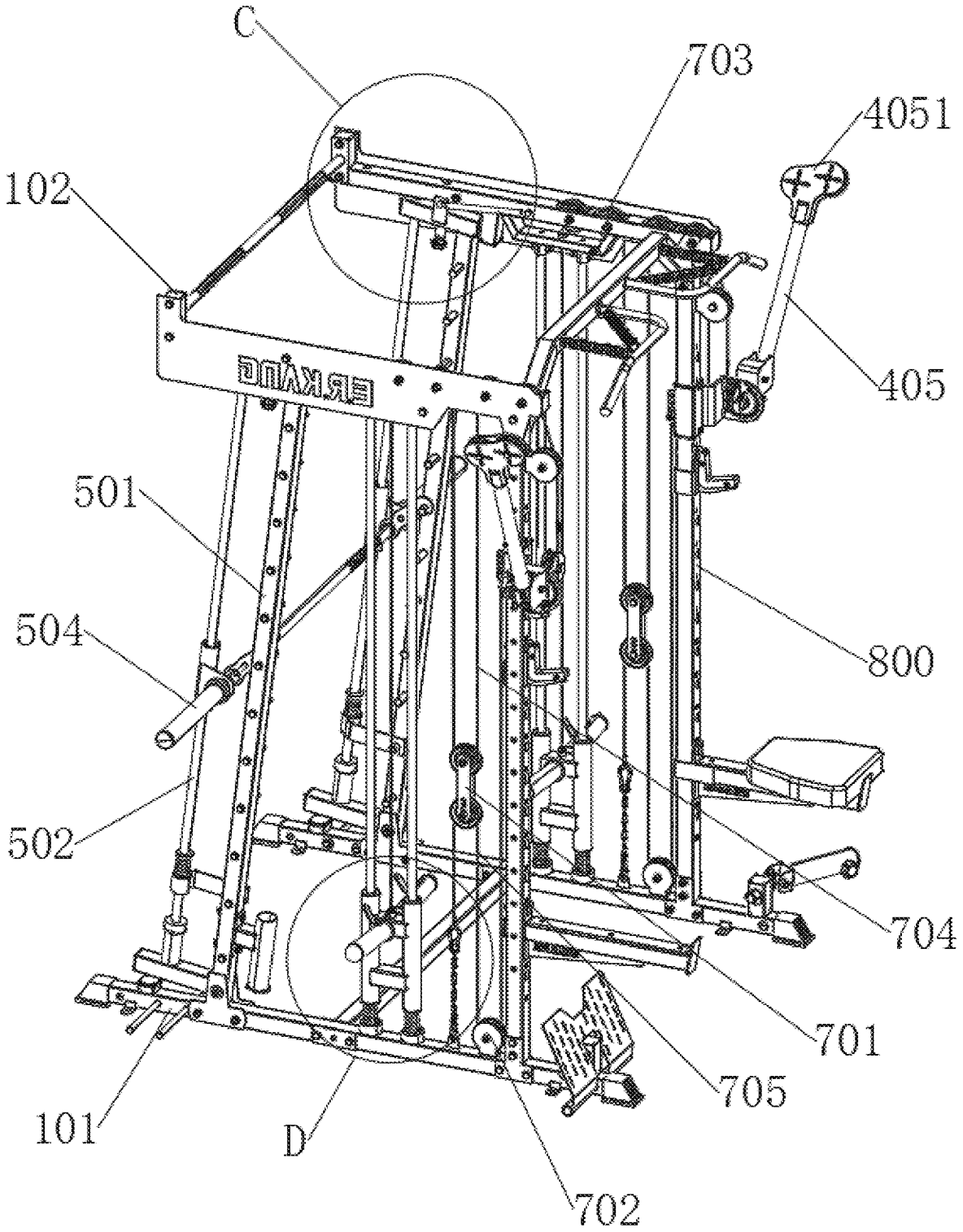
FIG. 5 is a structural schematic diagram of the entire invention from another perspective.

Refer to FIG. 5, a tension rope 704 is wound around one pulley of the movable pulley block 701 to form a left part and a right part, wherein one part of the tension rope 704 is connected with the sliding frame 602, and the other part of the tension rope 704 penetrates into the fly exercise device 400. The limit rope 705 is wound around another pulley of the movable pulley block 701 to form a left part and a right part, wherein one part of the limit rope 705 is connected with the bottom bracket 101, and the other part of the limit rope 705 is connected with the adjusting sleeve 401. The counterweight of the counterweight device can be directly transmitted to the user at an efficient ratio of 1:1, thus greatly improving the exercise efficiency of the user. What's more worth mentioning is that through this structure, users only need to install fewer weight stacks to meet the required weight, which not only simplifies the operation, but also significantly reduces the cost of fitness equipment, thus providing users with a more economical and convenient exercise experience.

Please refer to FIG. 5. In the above embodiment, in order to ensure the smooth sliding of the tension rope 704 and the limit rope 705, two sets of second fixed pulley 703 are also installed on the top bracket 102, two parts of the tension rope 704 respectively pass through two sets of second fixed pulley 703 and are respectively connected with the fly counterweight device 600 and the fly exercise device 400; the first fixed pulley 702 is installed on the bottom bracket 101, and when a part of the limit rope 705 is connected with the adjusting sleeve 401, the limit rope 705 will first pass through the first fixed pulley 702, so that the first fixed pulley 702 can play the role of moving and guiding the limit rope 705. By connecting one end of the limit rope 705 with the adjusting sleeve 401, when the adjusting sleeve 401 slides up and down along the adjusting rod 800 to adjust the height, the movable pulley block 701 can automatically move up and down, and the height adjustment can be realized synchronously.

Embodiment 2

Dual-area fitness equipment includes a rack 100, wherein the rack 100 is provided with at least two oppositely arranged exercise areas, and the two exercise areas are respectively set as a first exercise area 200 and a second exercise area 300; Both the first exercise area 200 and the second exercise area 300 are provided with exercise devices, one of which is a push-up exercise device 500 with adjustable inclination; the push-up exercise device 500 includes a push-up mechanism and an inclination adjusting mechanism, wherein the push-up mechanism includes at least two adjusting frames 501 and at least one barbell bar 504; the two adjusting frames 501 can be turned over in the opening direction of the exercise area, the barbell bar 504 is arranged between the two adjusting frames 501, and the rack 100 includes a bottom bracket 101 and a top bracket 102, which are vertically distributed and fixedly installed together.

In this embodiment, the push-up exercise device 500 is installed in the second exercise area 300, and the exercise device in the first exercise area 200 can be set as an exercise apparatus such as a tension trainer.

Two adjusting frames 501 are rotatably connected to both sides of the bottom bracket 101 and located below the top bracket 102. Each adjusting frame 501 is fixedly provided with a guide rod 502, and a sliding sleeve 503 is sleeved outside the guide rod 502, and a barbell bar 504 is installed between the two sliding sleeves 503.

The barbell bar 504 can be pushed to slide up and down along the guide rod 502, thus realizing the push-up exercise. Therefore, through the push-up exercise device 500, push-up exercise can be performed to exercise the whole body muscle groups. The second exercise area 300 is not limited to the push-up exercise device 500, but also can be equipped with related exercise components including pull-ups, squats, shoulder push, bench push, hard pull, so that the second exercise area 300 can become a comprehensive, efficient and multifunctional exercise space, thus meeting the needs of exercising the whole body muscles of users.

In addition, the adjusting frame 501 can rotate left and right through the rotary connection between the adjusting frame 501 and the bottom bracket 101, thereby adjusting the inclination of the guide rod 502. In this embodiment, the rotation angle of the adjustment frame 501 is preferably 0 to 7 degrees, so that the inclination adjustment range of the guide rod 502 is 0 to 7 degrees. By setting the inclination adjustment mechanism, the inclination of the guide rod 502 can be adjusted, which plays a role in positioning and fixing the angle.

Figure 6:
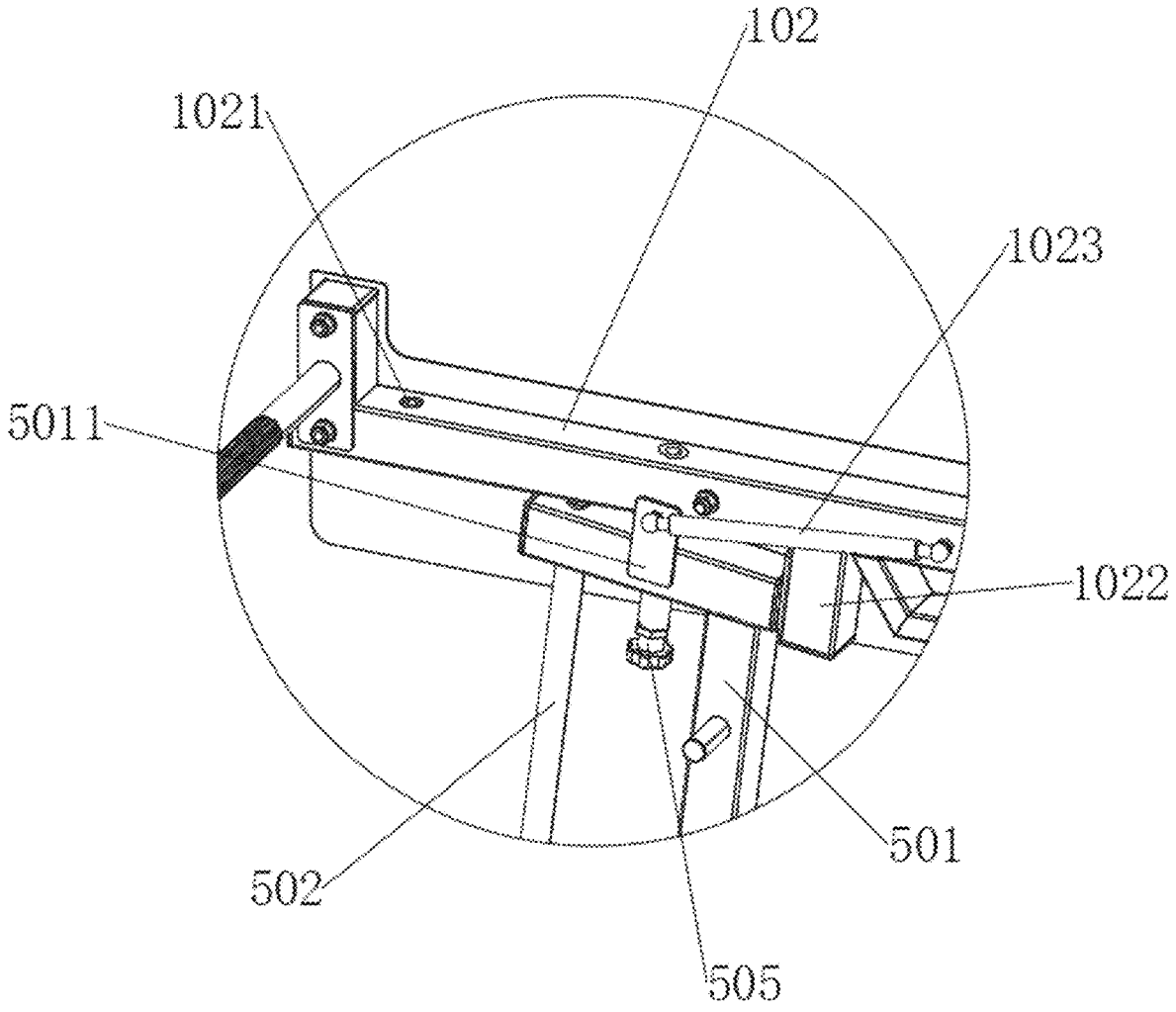
FIG. 6 is a partially enlarged schematic view at C in FIG. 5 according to the present invention.
Figure 8:
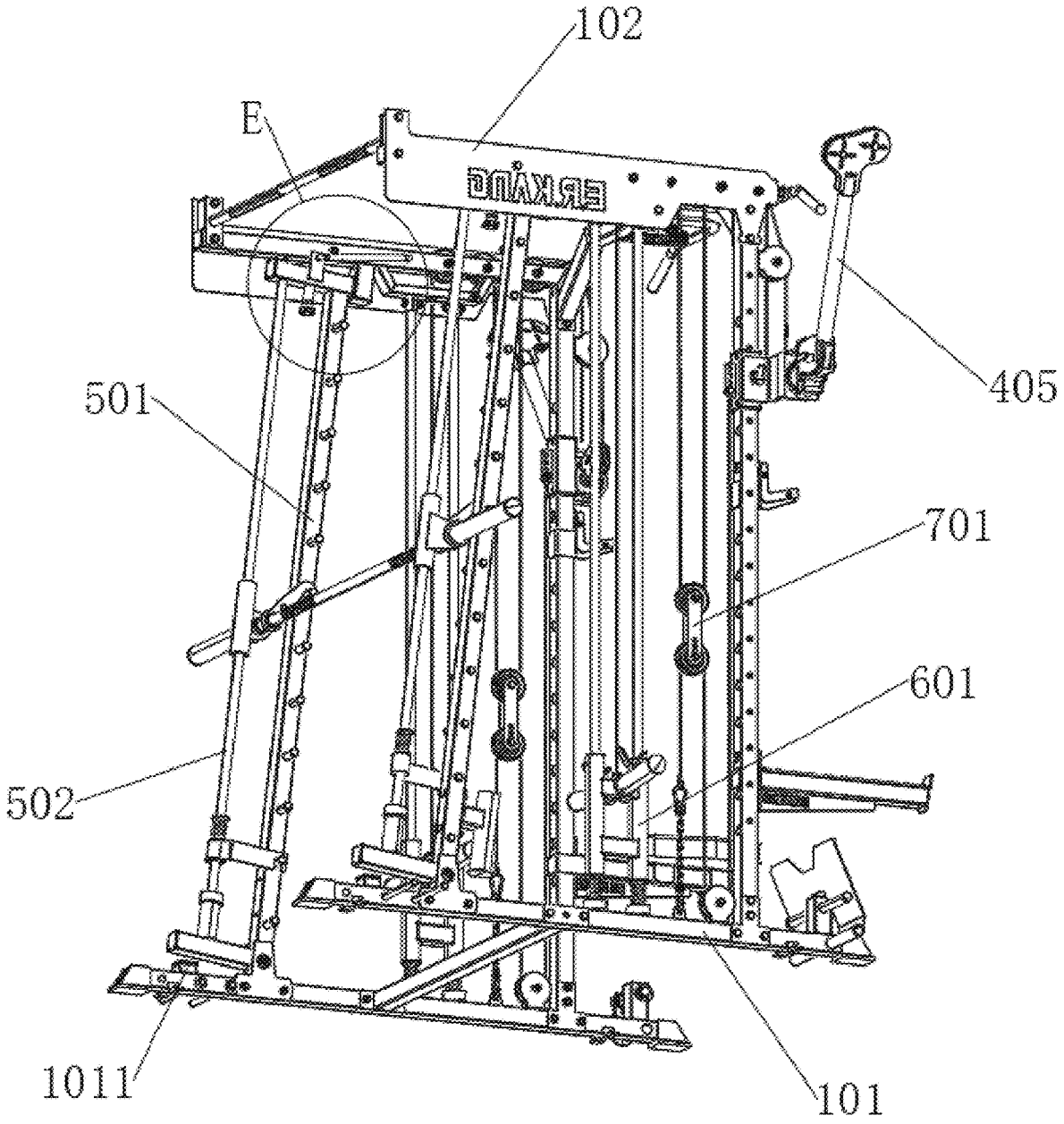
FIG. 8 is a structural schematic diagram of the entire invention from another perspective.
Figure 9:
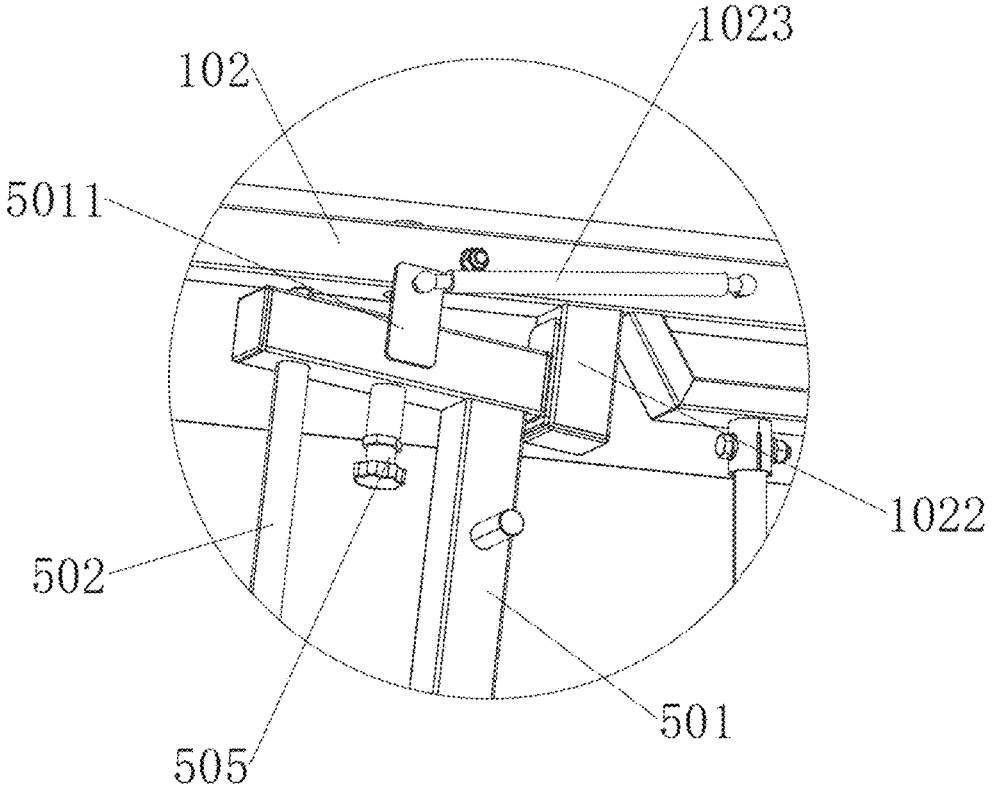
FIG. 9 is a partially enlarged schematic view at E in FIG. 8 according to the present invention.

According to the above, please refer to FIG. 6, FIG. 8 and FIG. 9, in this embodiment, the preferred implementation of the inclination adjustment mechanism is as follows:

The inclination adjust mechanism is arranged between that top bracket 102 of the adjusting frame 501, and includes a telescopic rod 1023, a limit block 1022 and a first positioning pin 505, wherein the telescopic rod 1023 is arrange between the adjusting frame 501 and the top bracket 102 and is respectively movably connected with the adjusting frame 501 and the top bracket 102; the limit block 1022 is installed on the top bracket 102, and is located at the side of the adjustment frame 501 facing away from the opening of the exercise area. When the adjustment frame 501 is at the maximum inclination, the limit block 1022 contacts the top of the adjustment frame 501, and the first positioning pin 505 is inserted into the top of the adjustment frame 501; at least two first positioning holes 1021 are formed in the top bracket 102, and when the adjustment frame 501 is at the maximum inclination, the first positioning pin 505 penetrates through the adjustment frame 501 and is inserted into one of the first positioning holes 1021; when the adjustment frame 501 is in a vertical state, the first positioning pin 505 penetrates through the adjustment frame 501 and is inserted into another first positioning hole 1021.

In this embodiment, the preferred movable connection mode between the telescopic rod 1023 and the adjustment frame 501 and the top bracket 102 is rotary connection. Therefore, when in use, by pushing and pulling the push-up mechanism, the adjusting frame 501 can be pushed to turn left and right, and then the inclination angle can be adjusted. The telescopic rod 1023 is composed of an inner tube and an outer tube, and the outer tube and the inner tube can slide telescopically, so that the telescopic rod 1023 is telescopic. At the same time, because the telescopic rod 1023 is rotatably connected with the adjustment frame 501 and the top bracket 102 respectively, the telescopic rod 1023 is telescopic when the adjustment frame 501 is turned left and right, thus playing the role of assisting the adjustment frame 501, and ensuring the stability and accuracy of the adjustment frame 501 in the turning process.

Moreover, in the preferred connection mode between the telescopic rod 1023 and the adjusting frame 501, the top of the adjusting frame 501 is also provided with a connecting sheet 5011, and the adjusting frame 501 is connected with the telescopic rod 1023 through the connecting sheet 5011, which can make the rotation between the adjusting frame 501 and the telescopic rod 1023 more convenient.

In this embodiment, the corresponding angles of the two first positioning holes 1021 are 0 degree and 7 degrees, respectively. When the adjusting frame 501 is turned to the right to the maximum extent, the adjusting frame 501 will abut against the limit block 1022, so that the limit block 1022 further plays a supporting and limiting role. At the same time, the first positioning pin 505 is aligned with the first positioning hole 1021 of 7 degrees, and then the first positioning pin 505 is inserted into the first positioning hole 1021 of 7 degrees, so that the adjustment frame 501 and the top bracket 102 can be fixed. thereby locking the inclination of the guide rod 502 to 7 degrees. When the adjusting frame 501 is turned to the left and perpendicular to the bottom bracket 101, the first positioning pin 505 will align with the first positioning hole 1021 of 0 degree, so that the inclination of the guide rod 502 can be locked to 0 degree by inserting the first positioning pin 505 into the first positioning hole 1021 of 0 degree. Moreover, in this embodiment, the bottom bracket 101 is also equipped with a cushion block 1011 located directly below the adjustment frame 501. As shown in FIG. 8, when the adjustment frame 501 rotates to 0 degree, the bottom of the adjustment frame 501 will just abut against the cushion block 1011, so that the cushion block 1011 can support and limit the bottom of the adjustment frame 501 and ensure that the adjustment frame 501 can be positioned to 0 more accurately.

The number of first positioning holes 1021 is not limited to the above two. In other embodiments (not shown), a plurality of first positioning holes 1021 can be uniformly opened, and each first positioning hole 1021 corresponds to a different angle, and the angle adjustment range is not limited to 0 degree to 7 degrees. Therefore, in this way, the push-up exercise device 500 not only has more adjustable angles, but also greatly expands its application range, so as to meet the diverse needs of different users and bring more personalized and efficient exercise experience to users.

Embodiment 3

Dual-area fitness equipment includes a rack 100, wherein the rack 100 is provided with at least two oppositely arranged exercise areas, and the two exercise areas are respectively set as a first exercise area 200 and a second exercise area 300; both the first exercise area 200 and the second exercise area 300 are provided with exercise devices, and the exercise functions of the two exercise devices are the same or different.

In this embodiment, the two exercise devices are preferably set as a fly exercise device 400 and a push-up exercise device 500, respectively, so that the fitness equipment can be used by users for fly exercise and push-up exercise.

In other embodiments, the exercise device can also be an exercise device such as a tension trainer, so that the exercise device can meet different application scenarios.

Embodiment 4

Dual-area fitness equipment includes a rack 100, wherein the rack 100 is provided with at least two exercise areas arranged oppositely, and the two exercise areas are respectively set as a first exercise area 200 and a second exercise area 300; both the first exercise area 200 and the second exercise area 300 are provided with exercise devices, and the two exercise devices are a fly exercise device 400 and/or a push-up exercise device 500. In this embodiment, two exercise devices can be set as a fly exercise device 400 or a push-up exercise device 500, or a fly exercise device 400 and a push-up exercise device 500 respectively.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also regarded as the protection scope of the present invention.

The invention has now been described in detail for the purposes of clarity and understanding. However, those skilled in the art will appreciate that certain changes and modifications may be practiced within the scope of the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting. The various features and processes described above may be used independently of one another, or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

What is claimed is:

1. Dual-area fitness equipment, comprising a rack, wherein:

the rack is provided with at least two exercise areas arranged oppositely, and the at least two exercise areas are respectively set as a first exercise area and a second exercise area;

the first exercise area and the second exercise area are each provided with respective exercise devices, wherein the exercise devices of the first exercise area comprise at least a first fly exercise device;

the first fly exercise device can be adjusted in angle, and the first fly exercise device is matched with a fly counterweight device and a pulley transmission device;

the fly counterweight device and the pulley transmission device are both located between the first exercise area and the second exercise area;

the rack comprises a bottom bracket and a top bracket, which are vertically distributed and fixedly installed together; at least one adjusting rod is arranged in the first exercise area or the second exercise area; the at least one adjusting rod is fixedly installed between the bottom bracket and the top bracket, and an adjusting sleeve is sleeved on the at least one adjusting rod; a fixing pin matched with the at least one adjusting rod is inserted into the adjusting sleeve, and the first fly exercise device is fixedly installed on the adjusting sleeve; and the first fly exercise device comprises a first angle adjusting mechanism, a second angle adjusting mechanism and a fly arm.

2. The dual-area fitness equipment according to claim 1, wherein the first angle adjusting mechanism comprises a Z-shaped plate and a U-shaped frame, wherein the Z-shaped plate is fixedly installed at one side of the adjusting sleeve, and the U-shaped frame is vertically arranged at one side of the Z-shaped plate and is rotatably connected with the Z-shaped plate.

3. The dual-area fitness equipment according to claim 2, wherein: a hollow shaft is fixedly installed on one side of the U-shaped frame facing the Z-shaped plate, and the other end of the hollow shaft is inserted into and rotatably connected with the Z-shaped plate; one side of the Z-shaped plate connected with the U-shaped frame is provided with a plurality of positioning holes, and the plurality of positioning holes are symmetrically distributed around the hollow shaft; and second positioning pins inserted into one side of the U-shaped frame facing the Z-shaped plate, and the second positioning pins are used in cooperation with the plurality of positioning holes.

4. The dual-area fitness equipment according to claim 3, wherein: the second angle adjusting mechanism is a rotating member, which is rotatably installed inside the U-shaped frame; the fly arm is installed at one end of the rotating member and extends out of the U-shaped frame; another plurality of positioning holes are uniformly formed on one side of the rotating member, and third positioning pins matched with the other plurality positioning holes are inserted into the U-shaped frame.

5. The dual-area fitness equipment according to claim 1, wherein the fly counterweight device comprises a guide frame, a sliding frame and a balance weight lever, wherein the guide frame is fixedly installed between the bottom bracket and the top bracket, and the sliding frame is sleeved on the guide frame and connected with the guide frame in a sliding way, and wherein at least one balance weight lever is installed on the sliding frame for sleeving of a weight stack.

6. The dual-area fitness equipment according to claim 5, wherein the pulley transmission device comprises a movable pulley block consisting of at least two pulleys, a tension rope and a limit rope, wherein the tension rope is wound around one pulley of the at least two pulleys of the movable pulley block and forms a left part and a right part, wherein one of said left part and right part of the tension rope is connected with the sliding frame, and the other of said left part and right part of the tension rope penetrates into the first fly exercise device.

7. The dual-area fitness equipment according to claim 6, wherein the limit rope is wound around another pulley of the at least two pulleys of the movable pulley block and forms a left part and a right part, wherein one of said left part and right part of the limit rope is connected with the bottom bracket and the other of said left part and right part of the limit rope is connected with the adjusting sleeve.

8. The dual-area fitness equipment according to claim 1, wherein the exercise devices of the first exercise area further comprise a second fly exercise device, wherein the second fly exercise device can be adjusted in angle, wherein the second fly exercise device is matched with a fly counterweight device and a pulley transmission device, and wherein the second fly exercise device comprises a first angle adjusting mechanism, a second angle adjusting mechanism and a fly arm.

9. Dual-area fitness equipment, comprising a rack, wherein:

the rack is provided with at least two exercise areas arranged oppositely, and the at least two exercise areas are respectively set as a first exercise area and a second exercise area;

the first exercise area and the second exercise area are each provided with respective exercise devices, and two of the exercise devices of the first exercise area are a first fly exercise device and a second fly exercise device; and each of the first fly exercise device and the second fly exercise devices comprises a respective first angle adjusting mechanism, a respective second angle adjusting mechanism and a respective fly arm.

10. A dual-area fitness equipment comprising a rack, wherein said rack is provided with at least two exercise areas, said at least two exercise areas being provided as a first exercise area and a second exercise area, respectively;

wherein said first exercise area and said second exercise area are each provided with respective exercise devices, wherein the exercise devices of the first exercise area comprise at least a first fly exercise device that is angle-adjustable;

wherein at least one adjusting rod is provided in said first exercise area or said second exercise area, wherein said at least one adjusting rod is provided with an adjusting sleeve, and said first fly exercise device is fixedly mounted on the adjusting sleeve; and wherein said first fly exercise device comprises a first angle adjusting mechanism, a second angle adjusting mechanism and a fly arm.

* * * * *